US012366124B2

(12) United States Patent
Jansson et al.

(10) Patent No.: US 12,366,124 B2
(45) Date of Patent: Jul. 22, 2025

(54) ELLIPTICAL DESIGN FOR SHANK ADAPTERS

(71) Applicant: SANDVIK MINING AND CONSTRUCTION TOOLS AB, Sandviken (SE)

(72) Inventors: Tomas Jansson, Sandviken (SE); Anders Nordberg, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 18/277,538

(22) PCT Filed: Feb. 17, 2022

(86) PCT No.: PCT/EP2022/053917
§ 371 (c)(1),
(2) Date: Aug. 16, 2023

(87) PCT Pub. No.: WO2022/175376
PCT Pub. Date: Aug. 25, 2022

(65) Prior Publication Data

US 2025/0075565 A1 Mar. 6, 2025

(30) Foreign Application Priority Data

Feb. 17, 2021 (EP) ..... 21157658

(51) Int. Cl.
*F16L 15/00* (2006.01)
*E21B 17/03* (2006.01)
*E21B 17/042* (2006.01)

(52) U.S. Cl.
CPC ..... *E21B 17/0426* (2013.01); *E21B 17/03* (2013.01)

(58) Field of Classification Search
CPC ..... F16L 15/00; F16L 15/001; F16L 15/006; E21B 17/0426; E21B 17/03
See application file for complete search history.

(56) References Cited

U.S. PATENT DOCUMENTS 6,109,620 A 8/2000 Robertts et al.
2018/0135782 A1* 5/2018 Ahola ..... E21B 1/38
2018/0135783 A1 5/2018 Wicksrom et al.

FOREIGN PATENT DOCUMENTS

EP 3095954 A1 11/2016

* cited by examiner

*Primary Examiner* — Aaron M Dunwoody
(74) *Attorney, Agent, or Firm* — Corinne R. Gorski

(57) ABSTRACT

A shank adapter, forming part of a drilling assembly, has a main body extending axially between a first end and a second end, an externally threaded male spigot portion provided at the second end, and a non-threaded shank positioned axially intermediate the main body and the threaded section. A radially projecting shoulder is positioned axially between the main body and the male spigot portion. The shank has a transition section positioned adjacent to the shoulder at the second end having an outside diameter that increases in a direction from the spigot portion to the shoulder. A cross-sectional shape profile of the outer surface of the transition section has a segment of an ellipse having a semi-major axis (a), a semi-minor axis (b) and an exponential factor (n) according to the equation:

$$\left|\frac{x}{a}\right|^n + \left|\frac{y}{b}\right|^n = 1$$

A ratio of the semi-major to semi-minor axes (a:b) is within the range 2b<a<8b.

13 Claims, 7 Drawing Sheets

ELLIPTICAL DESIGN FOR SHANK ADAPTERS

RELATED APPLICATION DATA

This application is a § 371 National Stage Application of PCT International Application No. PCT/EP2022/053917 filed Feb. 17, 2022 with priority to EP 21157658.2 filed Feb. 17, 2021.

FIELD OF INVENTION

The present invention relates to a rock drilling shank adapter and in particular, although not exclusively, to a coupling of a shank adapter configured to minimise stress concentrations.

BACKGROUND ART

Percussion drilling is used to create a long borehole via a plurality of elongate drill string rods coupled together end-to-end by interconnected male and female threaded ends. The well-established technique breaks rock by hammering impacts transferred from the rock drill bit, mounted at one end of the drill string, to the rock at the bottom of the borehole. Typically, the energy required to break the rock is generated by a hydraulically driven piston that contacts the end of the drill string via a shank adaptor to create a stress (or shock) wave that propagates through the drill string and ultimately to the base rock level. The shank adapter comprises a body having a threaded male connection at one end for connection to a drill string and at an opposite second end the body has an end section of solid material against which an impact piston integrated in the drilling machine acts. In connection to the solid end section there are also a set of splines provided for torsion or enablement of rotation of the shank adapter and the drill string.

When the threaded male end of the shank adapter is coupled to a female threaded end of the endmost drill rod, the joint is typically subjected to bending moment during drilling.

These bending moments fatigue the coupling and may lead to breakage within the threaded portion of the joint. Typically, it is the threaded male spigot that is damaged and determines the operational lifetime of the coupling.

In particular, the transition between the different diameters of the threaded male spigot and the main length of the shank adapter (or an annular shoulder on the shank adapter in the case of 'shoulder contact' couplings) provides a region for potentially high stress concentrations due to bending moments and tensile loads. Conventionally, the outside diameter of the shank adapter at the transition axially between the threaded male spigot and the main length or shoulder is flared radially outward with a curved shape profile having a single radius curvature that is as large as can be accommodated between the two regions. However, for a typical threaded coupling stressed by 200 MPa in tension, the transition region reaches a stress level of approximately 300 MPa. Fatigue and possible breakage are therefore very likely which causes significant disruption to a drilling operation. There is therefore a need for a shank adapter design that addresses these problems.

SUMMARY OF THE INVENTION

It is an objective of the present invention to provide a shank adapter having a male threaded coupling part that is optimised to minimise the likelihood of stress concentrations at the transition region between the shoulder on the shank adapter and the spigot to extend the operational lifetime of the shank adapter and minimise fatigue and the risk of breakage in use. It is a further specific objective to provide a shank adapter that is compatible with existing drilling apparatus and methods that comprises an enhanced capacity to withstand large bending moments and tensile loads.

The objectives are achieved by specifically configuring a transition region positioned axially at the interface with the end of the main length section, or an annular shoulder at the end of the main length section. The present invention provides a shank adapter to drill rod coupling that exhibits reduced stress concentrations compared to known designs at the junction of the male spigot with the main length section resultant from incident bending moments or tensile loads.

According to a first aspect of the present invention there is a shank adapter to form part of a drilling assembly, the shank adapter comprising: a main body extending axially between a first end and a second end; a male spigot portion provided at the second end having an externally threaded section and a non-threaded shank positioned axially intermediate the main body and the threaded section; a radially projecting shoulder positioned axially between the main body and the male spigot portion; the shank having a transition section positioned adjacent to the shoulder at the second end, the transition section having an outside diameter that increases in a direction from the spigot portion to the shoulder; wherein the cross-sectional shape profile of the outer surface of the transition section in the plane of the longitudinal axis comprises a segment of an ellipse having semi-major axis (a); a semi-minor axis (b) and an exponential factor (n) according to the equation:

$$\left|\frac{x}{a}\right|^n + \left|\frac{y}{b}\right|^n = 1$$

characterised in that the ratio of the semi-major to semi-minor axes (a:b) is within the range $2b<a<8b$.

Advantageously, this provides a male coupling end exhibiting enhanced stiffness and that is more resilient to bending moments and tensile forces. The transition section is configured to eliminate or at least minimise stress concentrations at the section where spigot projects axially from shoulder. If the ratio of the lengths of the semi-major to semi-minor axes are above or below this the stress concentrations increase. Consequently, the risk of breakage is reduced and so the operation lifetime of the shank adapter is increased. Optionally, the transition section may also comprise segments wherein the shape profile is straight and/or different curved profile.

Optionally, the non-threaded shank is divided axially into a straight part, positioned axially closest to threaded section, and a curved transition section, positioned axially closest to the side surface. It may be advantageous to increase the distance between the shoulder and threaded part. In this case it will be beneficial to include a straight section as well.

Alternatively, the non-threaded shank has only a curved transition section extending all the way from the side surface to the threaded section. When the non-threaded shank is shorter it is advantageous that there is only a curved transition section, i.e. no straight section, as this aids in keeping the stress concentration as low as possible.

Preferably, the ratio of the semi-major to semi-minor axes (a:b) is within the range $2.5b<a<6b$. Advantageously, within the narrowed ratio range the stress concentrations at the section where the spigot projects axially from the shoulder are further reduced meaning that there is enhanced capacity to withstand large bending moments and tensile stresses.

Preferably, the semi-minor axis (b) is proportionate to the dimension of the threaded section according to the following equation:

$$0.5\left(\frac{D_y}{2}-\frac{D_i}{2}\right)\leq b\leq 2\left(\frac{D_y}{2}-\frac{D_i}{2}\right)$$

wherein Di is the diameter of the threaded section between opposing troughs and Dy is the diameter of the threaded section between opposing helical ridges. Advantageously, the length of the semi-major axis (b) is as large as possible, as this provides an elliptical shape with no sharp ends and therefore having the lowest stress concentration. However, if the length of the semi-major (b) is too high, there would effectively be no shoulder and so energy cannot be transferred effectively between the male and female ends, which would result in the female end of the rod breaking.

Preferably, the exponential factor (n) is in the range $1\leq n\leq 3$. Advantageously, this provides a transition section having an elliptical profile with the lowest stress concentration.

Optionally, a vertex of the ellipse is positioned at a tangent with the annular side surface of the shoulder. Alternatively, the vertex of the ellipse undercuts the annular side surface of the shoulder. Different load cases may benefit from different forms of the ellipse.

Optionally, the x-axis of the ellipse is parallel to the longitudinal axis. Alternatively, the x-axis of the ellipse is tilted with respect to the longitudinal axis. Different load cases may benefit from different forms of the ellipse.

Optionally, the profile of the outer surface of the transition section in the plane of the longitudinal axis comprises a quarter segment of an ellipse. Alternatively, the cross-sectional shape profile of the outer surface of the transition section in the plane of the longitudinal axis comprises greater than a quarter segment of an ellipse. Alternatively, the cross-sectional shape profile of the outer surface of the transition section in the plane of the longitudinal axis comprises a less than quarter segment of an ellipse. Different load cases may benefit from different forms of the ellipse.

Within the specification, reference to 'curvature' encompasses a smooth or gradual change in surface profile and a plurality of sequential linear increases (or decreases) in diameter that collectively may be regarded as a 'curved' shape profile. For example, the term 'curvature' encompasses relatively small linear step changes such that an edge or middle region of each step may be considered to collectively define a curve.

Preferably, the shank adapter comprises a shoulder projecting radially from the main length section wherein an outside diameter of the shoulder is greater than an outside diameter of the main length section and the transition section of the shank. Such a configuration allows for the conventional 'shoulder contact' coupling between the male spigot and the female sleeve that is preferred over the alternative 'bottom contact' due to the larger diameter and surface area contact between the male and female parts.

Preferably, a side surface of the shoulder that is in contact with the transition section comprises an annular radially outer region that is aligned substantially perpendicular to the longitudinal axis. The curved transition section therefore does not continue over the full radial length of the annular side surface to provide a flat annular surface for contact by the annular end face of the female sleeve.

Optionally, the threaded section comprises at least one axially extending helical ridge and groove, wherein an outside diameter of the shank axially between the threaded section and the transition section is substantially equal to an outside diameter of the threaded section at an axial and a radial position corresponding to the ridge of the threaded section. Optionally, the threaded section comprises a plurality of threads formed as a double or triple helix etc. Such configurations can be selected to achieve a desired threaded profile having desired mechanical and physical properties.

Optionally, a cross sectional area of the shank is at least equal to a cross sectional area of the main length section in a plane perpendicular to the longitudinal axis over a full axial length of the shank between the threaded section and the main length section or the shoulder. Optionally, the diameter of the threaded section is slightly smaller than the diameter of the main length section. Accordingly, the shank is configured to be robust during bending moments and tensile loads.

According to a second aspect of the present invention there is provided a drilling assembly comprising a shank adapter as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
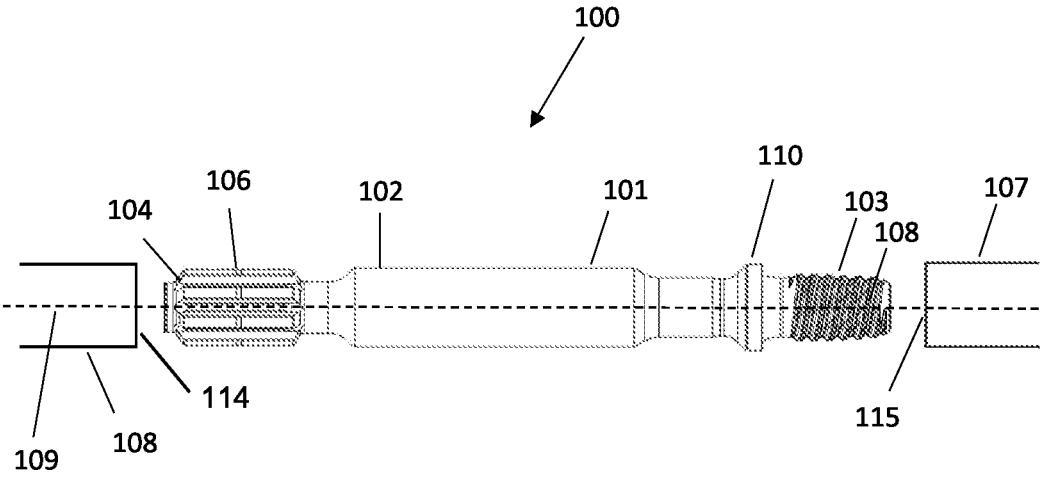
FIG. 1 is an external view of a shank adapter drill string forming part of a rock drilling apparatus.

FIG. 1 shows a shank adapter 100 comprising a main body 101 having a forward end 103 and a rearward end 104 relative to a longitudinal axis. A plurality of axially parallel elongate splines 106 project radially outward from an external surface 102 at a rearward region of the main body 101 towards rearward end 104. Splines 106 are configured to be engaged by corresponding splines of a rotational motor (not shown) to induce rotation of adaptor 100 about axis 109 during drilling operations. The adaptor 100 further comprises a flush hole (or bore) 105 not shown) positioned axially between ends 103, 104 and extending radially through the main body 101 from external surface 102 to an internal cavity or region extending axially within adaptor 100. The shank adaptor 100 is configured for coupling to an elongate drill string and to allow transmission of a stress wave to a drill tool (not shown) located at the deepest region of the drill hole to impart the percussion drilling action. In particular, the adaptor forward end 103 may be coupled to a rearward end of a rearwardmost elongate drill rod 107 forming a part of the drill string. The rearwardmost adaptor end 104 is configured to be contacted by a hydraulically driven piston 108 that creates the stress wave within adaptor 100 and the drill string. The forward end 103 comprises an annular shoulder 110 from which projects axially a male spigot 108.

Figure 2:
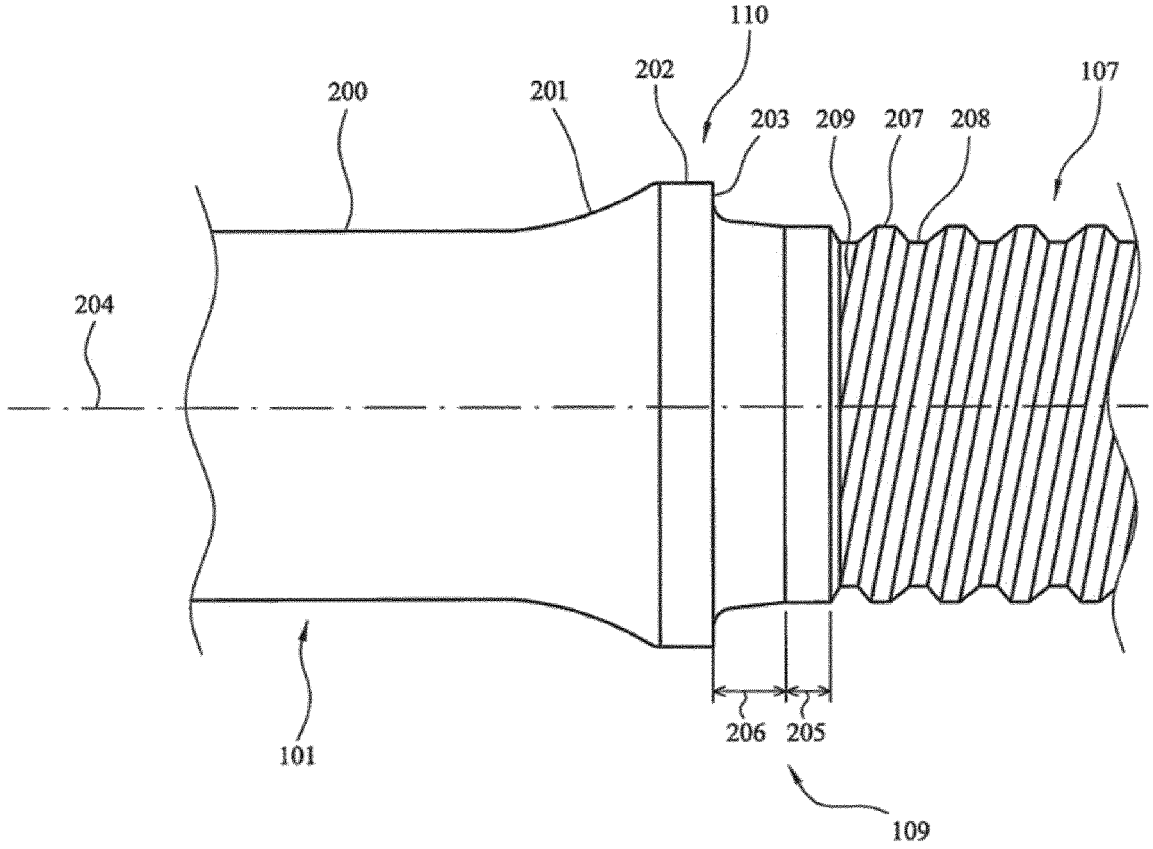
FIG. 2 is an external side view of one end of the shank adapter of FIG. 1 at the region of the male coupling according to a specific implementation of the present invention wherein the non-threaded shank is divided axially into a straight part and a curved transition section.

FIG. 2 shows that the spigot 108 is divided axially into an endmost threaded section 107 and a non-threaded shank 109 positioned axially intermediate threaded section 107 and the shoulder 110. When the male end of the shank adapter and the female end of the adjacent drill rod are coupled, an axially endmost annular surface 115 of the a rearwardmost elongate drill rod 107 abuts against the shoulder 110 (as shown on FIG. 1) such that an annular end face 114 of the male spigot 108 is housed fully within a sleeve (not shown) on the rearwardmost elongate drill rod 107.

The tubular main body 101 comprises a cylindrical external surface 200 that is flared radially outward at the shoulder 110 to provide an annular concave region 201 that terminates at a cylindrical surface 202 located at the shoulder 110. A diameter and cross-sectional area of the surface 202 in a plane perpendicular to the axis 204 is accordingly greater than a corresponding diameter or cross-sectional area (in a parallel plane) of the main length surface 200. The shoulder 110, in particular the cylindrical surface 202 is terminated at the spigot side by an annular side surface 203 aligned perpendicular to the axis 204. The spigot 108 projects axially from a radially inward region of the surface 203 and is aligned coaxial with the main body 101 and the annular shoulder 110. The diameter of the main body 101 could be the same or less than the diameter of the male spigot 108. The main body 101 may have a constant or varying diameter along its length.

The threaded section 107, according to the specific implementation, comprises a pair of helical turns 209 that extend axially from shank 109 to annular end face 114. In particular, a pair of helical ridges 207 and troughs 208 extend axially over section 107. The non-threaded shank 109 may be divided axially into a straight section 205, positioned axially closest to threaded section 107, and a curved transition section 206, positioned axially closest to the side surface 203. An external surface of straight section 205 is substantially parallel to axis 204 whilst the external surface of transition section 206 tapers radially outward in a direction from the threaded section 107 to contact against the annular side surface 203. A combined axial length of the straight parts 205 and the transition section 206 could be equal to, greater than or less than an axial length of shoulder surface 202 but less than an axial length of threaded section 107. Accordingly, a diameter or cross-sectional area of the straight section 205 is less than a diameter or cross-sectional area of the transition section 206. Additionally, a diameter or cross-sectional area of the straight part 205 is approximately equal to a diameter or cross-sectional area of the threaded section 107 at an axial and radial position corresponding to the radially outermost part of peak 207.

Figure 3:
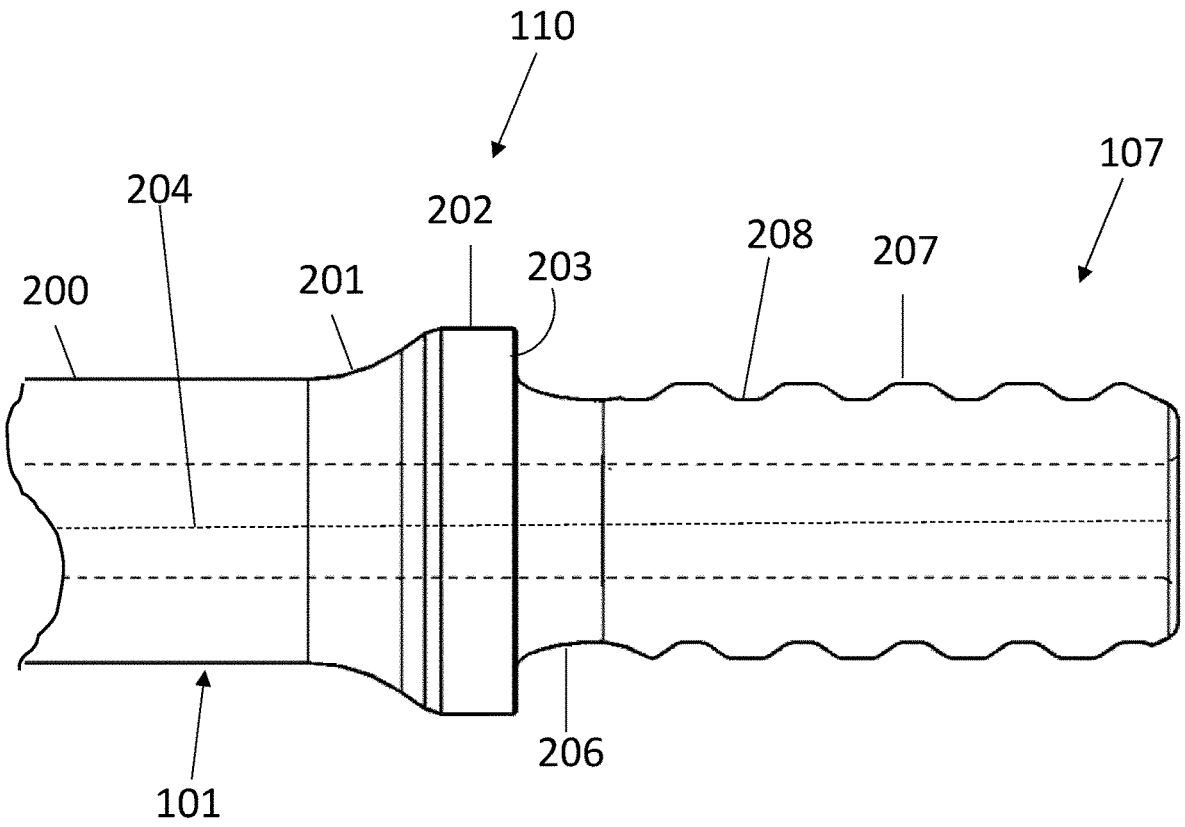
FIG. 3 is an external side view of the one end of the shank adapter of FIG. 1 at the region of the male coupling according to an alternative implementation of the present invention wherein the non-threaded shank has only a curved transition section.

FIG. 3 shows that alternatively, the non-threaded shank 109 may have only a curved transition section 206 extending all the way from the side surface 203 to the threaded section 107. In other words, there could be no straight length part 205.

Referring to FIGS. 2 and 3, the transition section 206 may be considered a transition region between spigot 108 and the annular shoulder 110. As illustrated in FIGS. 2 and 3, the transition section 206 increases in diameter and cross-sectional area from threaded section 107 to the shoulder 110, such that the external surface profile of the transition section 206 in a plane along axis 204 is curved according to a gradual curvature having a profile corresponding to quarter segment of a perimeter of an ellipse 214, or slightly more or slightly less than a quarter segment of an ellipse 214. The ellipse 214 has a semi-major axis (x) and a semi-minor axis (y). Preferably, there is no abrupt change along the length of the transition section 206 from a first radius to a second radius, instead there is a continuous and gradual change in the radius along the length of the transition section 206. Optionally, the transition section 206 may also comprise segments wherein the shape profile is straight and/or has a different curved profile, which could be positioned at either end of the elliptical profile or as an interruption part way along the elliptical profile.

The equation of an ellipse is defined by a Lamé curve when n=2:

$$\left|\frac{x}{a}\right|^n + \left|\frac{y}{b}\right|^n = 1$$

Wherein:

x is the co-ordinate on the x axis;

y is the co-ordinate on the y axis;

a is the semi-major axis (x);

b is the semi-minor axis (y);

n determines the shape of the curve. n=2 defines an ordinary ellipse. n<2 a hypoellipse and n>2 a hyperellipse.

Figure 4:
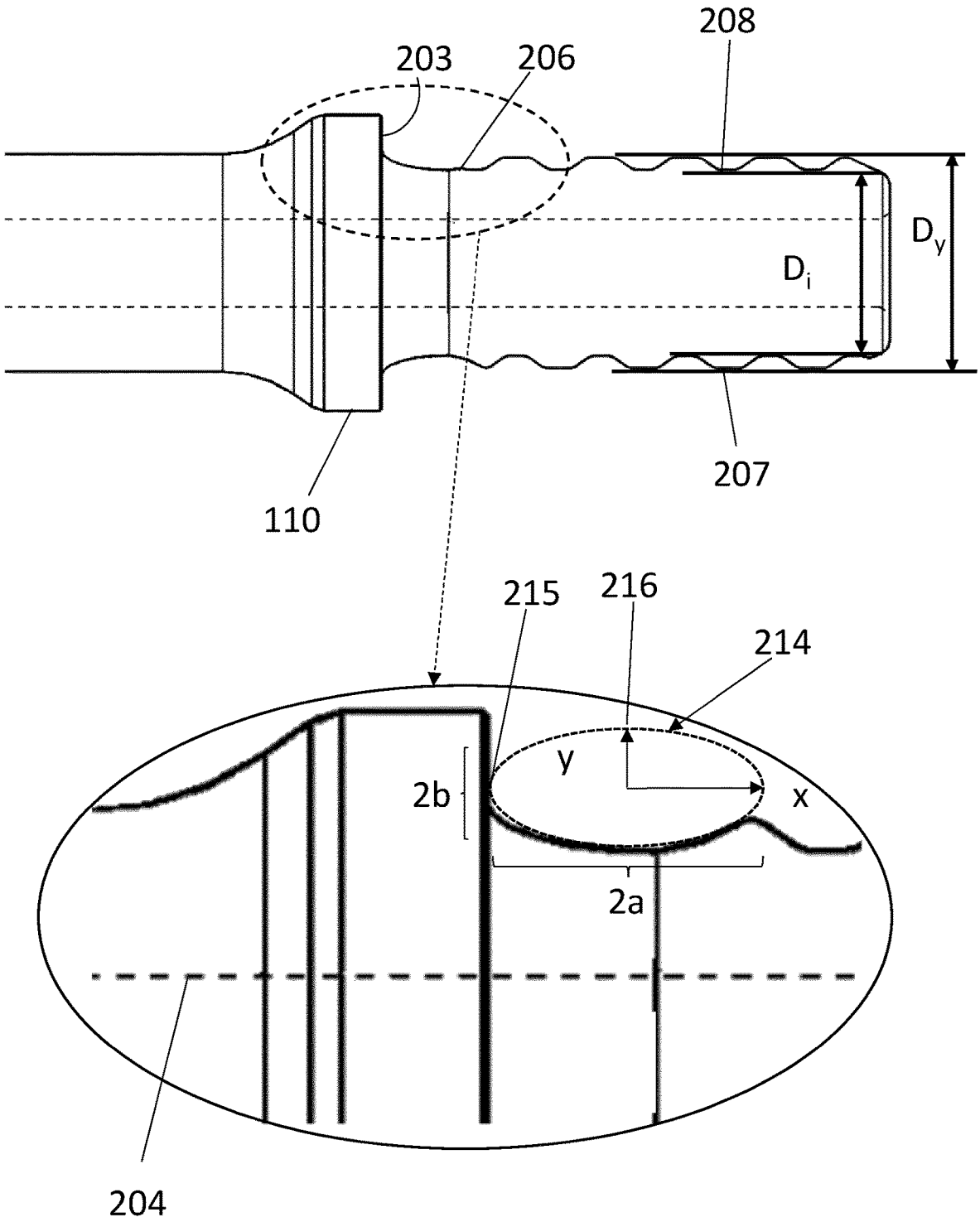
FIG. 4 is a magnified view of a shank part of the male coupling according to one embodiment of the invention wherein the vertex of the elliptical profile of the transition section is at a tangent to the shoulder.

The elliptical profile 214 is shown on expanded view of the transition section 206 in FIG. 4.

In the present invention the ratio of the major to minor axes, (a:b) is within the range 2b<a<8b, preferably, 2b<a<6b, more preferably 2.5b<a<6b, even more preferably 2.5b<a<5.75b.

Preferably, the semi-minor axis (b) is as large as possible. More preferably the semi-minor axis (b) is proportionate to the diameter of the threaded section 107 of the male spigot portion 108 according to the following equation:

$$0.5\left(\frac{D_y}{2} - \frac{D_i}{2}\right) \le b \le 2\left(\frac{D_y}{2} - \frac{D_i}{2}\right)$$

Wherein (as shown on FIG. 4):

Di=diameter of the threaded section 107 between opposing troughs 208;

Dy=diameter of the threaded section 107 between opposing helical ridges 207.

Preferably, the exponential factor n is in the range 1≤n≤3, preferably 1.8≤n≤2.2, most preferably 2.

The equation of the elliptical profile of the transition section 206 can be measured using a contour measuring machine. The contour measuring machine drags a needle over the surface of the transition section 206, then the equipment will try to fit different geometries and then output the equation of shape profile measured.

At each endpoint of the semi-major axis (x) is a vertex 215 of the ellipse 214 and at each endpoint of the minor axis (y) there is a co-vertex 216 of the ellipse 214. Optionally, the vertex 215 of the ellipse is positioned at a tangent with the annular side surface 203 of the shoulder 110, as shown in FIG. 4.

Figure 5:
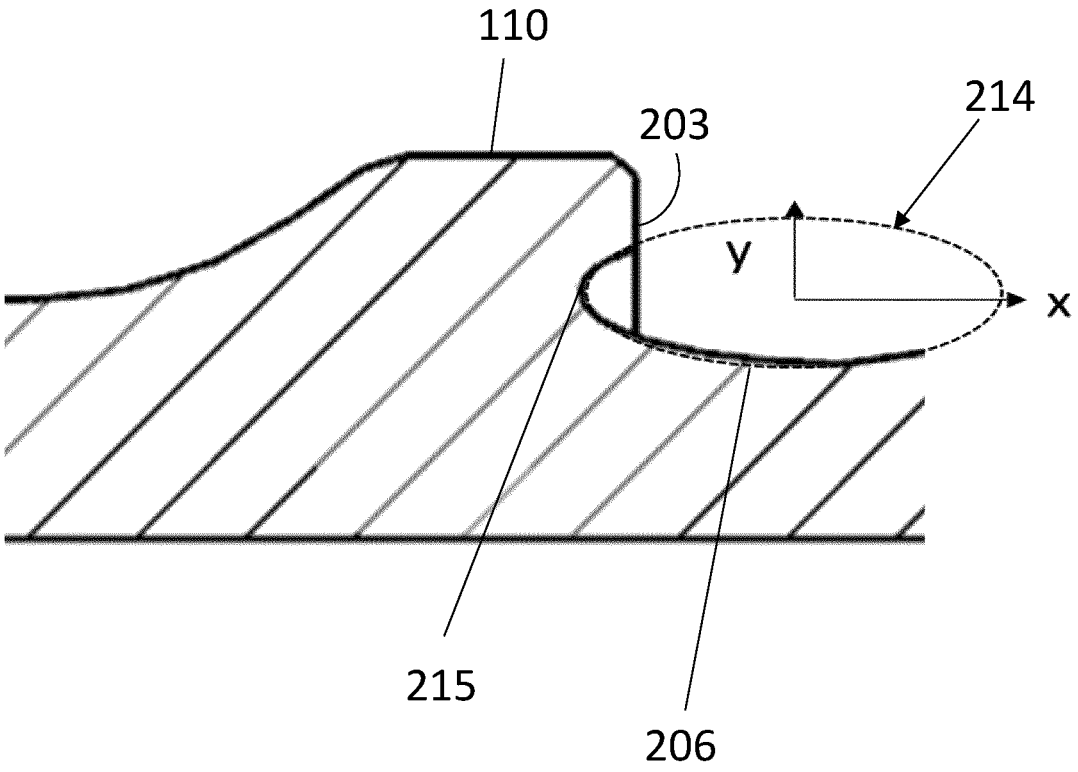
FIG. 5 is a magnified view of a shank part of the male coupling according to an alternative embodiment of the invention wherein the elliptical profile of the transition section undercuts the annular side surface of the shoulder.

FIG. 5 shows an alternative design, where the vertex 215 of the ellipse 214 undercuts the annular side surface 203 of the shoulder 110.

Optionally, the x-axis of the ellipse 214 is parallel to the longitudinal axis 204, as shown in FIG. 4.

Figure 6:
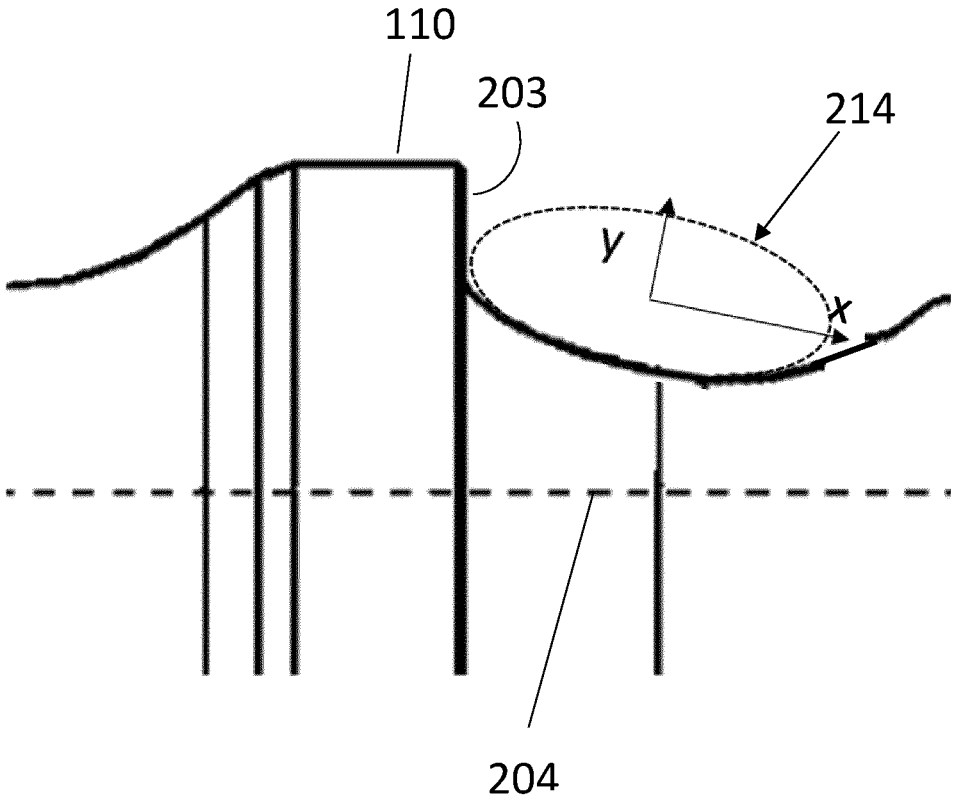
FIG. 6 is a magnified view of a shank part of the male coupling according to an alternative embodiment of the invention wherein the elliptical profile of the transition section is tilted.
Figure 7A:
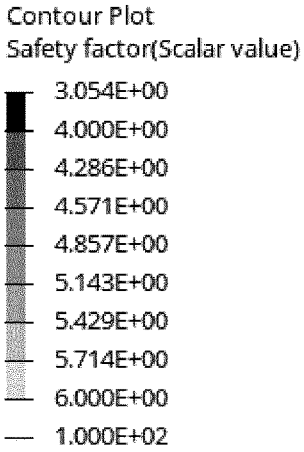
Fig 7a (prior art)
FIGS. 7*a-g* are safety factor images comparing the prior art (FIG. 7*a*) to different embodiments of the invention (FIGS. 7*b-g*)
Figure 7A:
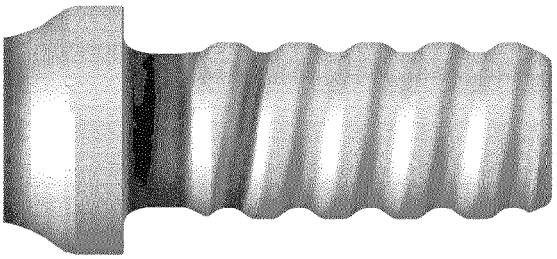
Fig 7a (prior art)
Figure 7B:
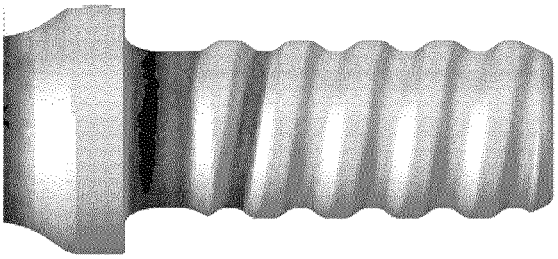
Figure 7C:
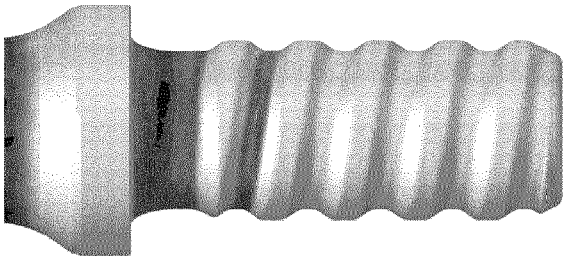
Figure 7D:
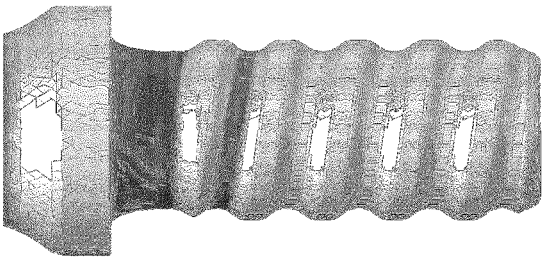
Figure 7E:
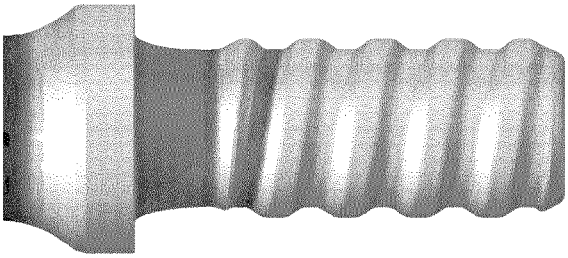
Figure 7F:
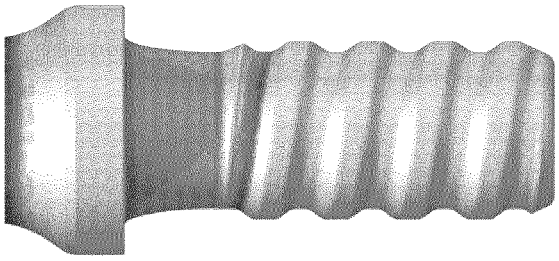
Figure 7G:
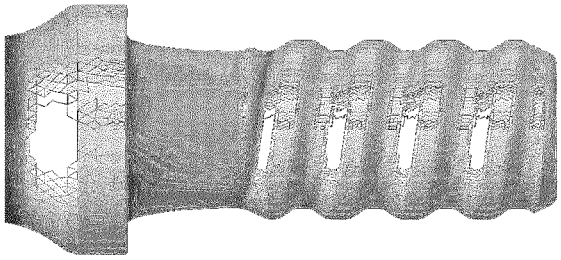

FIG. 6 shows an alternative wherein the x-axis of the ellipse 214 is tilted with respect to the longitudinal axis of 204.

It should be appreciated that any combination of the position of the vertex 215 can be combined with any orientation of the x-axis with respect to the longitudinal axis 204 as described hereinabove.

The profile of the transition section 206 provides a male coupling end exhibiting enhanced stiffness and that is more resilient to bending moments and tensile forces with respect to conventional couplings. Additionally, transition section 206 is configured to eliminate or at least minimise stress concentrations at the section where spigot 108 projects axially from shoulder 110.

FIGS. 7*a-g* show safety factor images captured using the Dang van criterion using rotating bending as the load case for different transition section 206 profiles as shown in Table 1:

TABLE 1

Description of transition section profiles used in the safety factor images.

| FIG. | Transition section profile | Safety factor |
|---|---|---|
| 7a (prior art) | Double radii: First radii = 20 mm and second radii = 4 mm | 3.8 |
| 7b (invention) | Elliptical: a = 10 mm and b = 4.65 mm | 3.9 |
| 7c (invention) | Elliptical: a = 13 mm and b = 4.65 mm | 4.2 |
| 7d (invention) | Elliptical: a = 16 mm and b = 4.65 mm | 4.4 |
| 7e (invention) | Elliptical: a = 21 mm and b = 4.65 mm | 4.7 |
| 7f (invention) | Elliptical: a = 26 mm and b = 4.65 mm | 5.0 |
| 7g (invention) | Elliptical: a = 31 mm and b = 4.65 mm | 4.7 |

The risk for failure is increased as the value of the Dang van criterion in decreased. Thus, darker colours mean higher risk for failure. By comparing FIG. 7*a* (prior art) to FIGS. 7*b-g* (embodiments of the present invention) it can be seen that the risk of failure occurring has decreased for the inventive profiles. The stress images were captured using implicit analysis in LS-Dyna and the Dang van criterion is extracted using the nCode software. Table 1 also shows the safety factor measured from this equipment, a higher safety factor is better and indicates lower stress. It can be seen from the results in Table 1 that all the inventive samples have a higher safety factor compared to the prior art version.

The invention claimed is:

1. A shank adapter arranged to form part of a drilling assembly, the shank adapter comprising:

a main body extending axially between a first end and a second end;

a male spigot portion provided at the second end having an externally threaded section and a non-threaded shank positioned axially intermediate the main body and the threaded section;

a radially projecting shoulder positioned axially between the main body and the male spigot portion; and the shank having a transition section positioned adjacent to the shoulder at the second end, the transition section having an outside diameter that increases in a direction from the spigot portion to the shoulder, wherein a cross-sectional shape profile of the outer surface of the transition section in a plane of a longitudinal axis comprises a segment of an ellipse having a semi-major axis (a), a semi-minor axis (b) and an exponential factor (n) according to the equation:

$$\left|\frac{x}{a}\right|^n + \left|\frac{y}{b}\right|^n = 1$$

and, wherein a ratio of the semi-major to semi-minor axes (a:b) is within the range 2b<a<8b, and wherein the exponential factor (n) is in the range 1≤n≤3.

2. The shank adapter according to claim 1, wherein the non-threaded shank is divided axially into a straight part, positioned axially closest to threaded section, and a curved transition section, positioned axially closest to the side surface.

3. The shank adapter according to claim 1, wherein the non-threaded shank has only a curved transition section extending all the way from the side surface to the threaded section.

4. The shank adapter according to claim 1, wherein the ratio of the semi-major to semi-minor axes (a: b) is within the range 2.5b<a<6b.

5. The shank adapter according to claim 1, wherein the semi-minor axis (b) is proportionate to the dimension of the threaded section according to the following equation:

$$0.5\left(\frac{D_y}{2} - \frac{D_i}{2}\right) \le b \le 2\left(\frac{D_y}{2} - \frac{D_i}{2}\right)$$

wherein Di is the diameter of the threaded section between opposing troughs and Dy is the diameter of the threaded section between opposing helical ridges.

6. The shank adapter according to claim 1, wherein a vertex of the ellipse is positioned at a tangent with the annular side surface of the shoulder.

7. The shank adapter according to claim 6, where the vertex of the ellipse undercuts the annular side surface of the shoulder.

8. The shank adapter according to claim 1, wherein an x-axis of the ellipse is parallel to the longitudinal axis.

9. The shank adapter according to claim 1, wherein an x-axis of the ellipse is tilted with respect to the longitudinal axis.

10. The shank adapter according to claim 1, wherein the cross-sectional shape profile of the outer surface of the transition section in the plane of the longitudinal axis comprises a quarter segment of the ellipse.

11. The shank adapter according to claim 1, wherein the cross-sectional shape profile of the outer surface of the transition section in the plane of the longitudinal axis comprises greater than a quarter segment of the ellipse.

12. The shank adapter according to claim 1, wherein the cross-sectional shape profile of the outer surface of the transition section in the plane of the longitudinal axis comprises less than a quarter segment of the ellipse.

13. A drilling assembly comprising a shank adapter according to claim 1.

* * * * *